US006721975B1

(12) United States Patent
Lemire

(10) Patent No.: US 6,721,975 B1
(45) Date of Patent: Apr. 20, 2004

(54) OVERLAPPING SIDERAIL ASSEMBLY FOR BED

(75) Inventor: Guy Lemire, Beaumont (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/435,747

(22) Filed: May 9, 2003

(51) Int. Cl.[7] ..... A47C 21/08
(52) U.S. Cl. ..... 5/430; 5/425; 5/600
(58) Field of Search ..... 5/600, 424, 425, 5/428, 430

(56) References Cited

U.S. PATENT DOCUMENTS

| | | | | | |
|---|---|---|---|---|---|
| 6,038,721 | A | * | 3/2000 | Gordon | 5/663 |
| 6,401,277 | B1 | * | 6/2002 | Savage et al. | 5/430 |
| 6,615,426 | B1 | * | 9/2003 | Risk, Jr. | 5/425 |
| 2003/0093860 | A1 | * | 5/2003 | Kramer et al. | 5/600 |

* cited by examiner

*Primary Examiner*—Teri Pham Luu
(74) *Attorney, Agent, or Firm*—Flynn, Thiel, Boutell & Tanis, P.C.

(57) ABSTRACT

An overlapping siderail assembly for a bed having a head end and a foot end as well as a support deck. At least one pair of siderails are provided on one side of the bed, each one of the pair having a generally uniform thickness over a majority of a length of each thereof and extend in a plane that is generally parallel to a plane containing a longitudinal axis of the bed. First and second ones of the pair of siderails each have a head end and a foot end, the foot end of the first one having a first region of reduced thickness on a first side thereof facing in a first direction, the head end of the second one having a second region of reduced thickness on a second side thereof facing in a second direction opposite to the first direction. The first and second regions are oriented in an overlapping side-by-side relation so that there exists no longitudinal gap between the first and second ones of the pair and the thickness at the overlapping location conforms to the aforesaid uniform thickness.

12 Claims, 9 Drawing Sheets

FOWLER 90° - THIGH 0° ISO

OVERLAPPING SIDERAIL ASSEMBLY FOR BED

FIELD OF THE INVENTION

This invention relates to a bed having siderails thereon and, more particularly, at least a pair of siderails on one side of the bed that overlap at the mutually adjacent ends thereof so that no gap exists between them in all positions of relative movement therebetween and while maintaining a generally uniform thickness between the head end of the siderails and the foot end thereof.

BACKGROUND OF THE INVENTION

In the field of beds configured for use in patient care environments, it is important to provide a safety siderail feature to prevent accidental exit from the bed as well as preventing unauthorized bed exit by the patient. It is also important to prevent the patient occupying the bed from becoming entrapped by the structure of the siderail configuration during its use and during movement of the relatively movable components of the bed. Various designs have been created for closing the gap between the head end siderail and the foot end siderail. However, the componentry known to date is expensive to provide and oftentimes is not aesthetically pleasing. It is desirable to provide a less expensive, safe and aesthetically pleasing siderail configuration for a patient care bed.

Accordingly, it is an object of the invention to provide a head end and foot end siderail configuration for a patient care bed that are of a light weight construction, aesthetically pleasing and are very durable and safe in use.

It is a further object of the invention to provide head end and foot end siderails, as aforesaid, having a uniform thickness from the head end to the foot end of the entire configuration.

It is a further object of the invention to provide head end and foot end siderails, as aforesaid, wherein a region of reduced thickness is provided on both of the head end and foot end siderails at the mutually adjacent ends thereof, which regions of reduced thickness are overlapping and oriented in a side-by-side relation so that there exists no gap between the two siderail components.

SUMMARY OF THE INVENTION

The objects and purposes of the invention are met by providing a frame having a head end and a foot end as well as a support deck mounted on the frame. The support deck has a head end section and a seat section, the head end section being: supported for movement relative to the seat section and between a horizontally aligned position and an upright position inclined relative to the horizontally aligned position. At least one pair of siderails are provided on one side of the bed, each one of the pair having a generally uniform thickness over a majority of a length thereof and extend in a plane that is generally parallel to a plane containing a central longitudinal axis of the bed. First and second ones of the pair of siderails each have a head end and a foot end, the foot end of the first one having a first region of reduced thickness on a first side thereof facing in a first direction, the head end of the second one having a second region of reduced thickness on a second side thereof facing in a second direction opposite to the first direction. The first and second regions are oriented in an overlapping side-by-side relation so that there exists no gap between the first and second ones of the pair and the thickness at the overlapping location conforming to the aforesaid uniform thickness.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
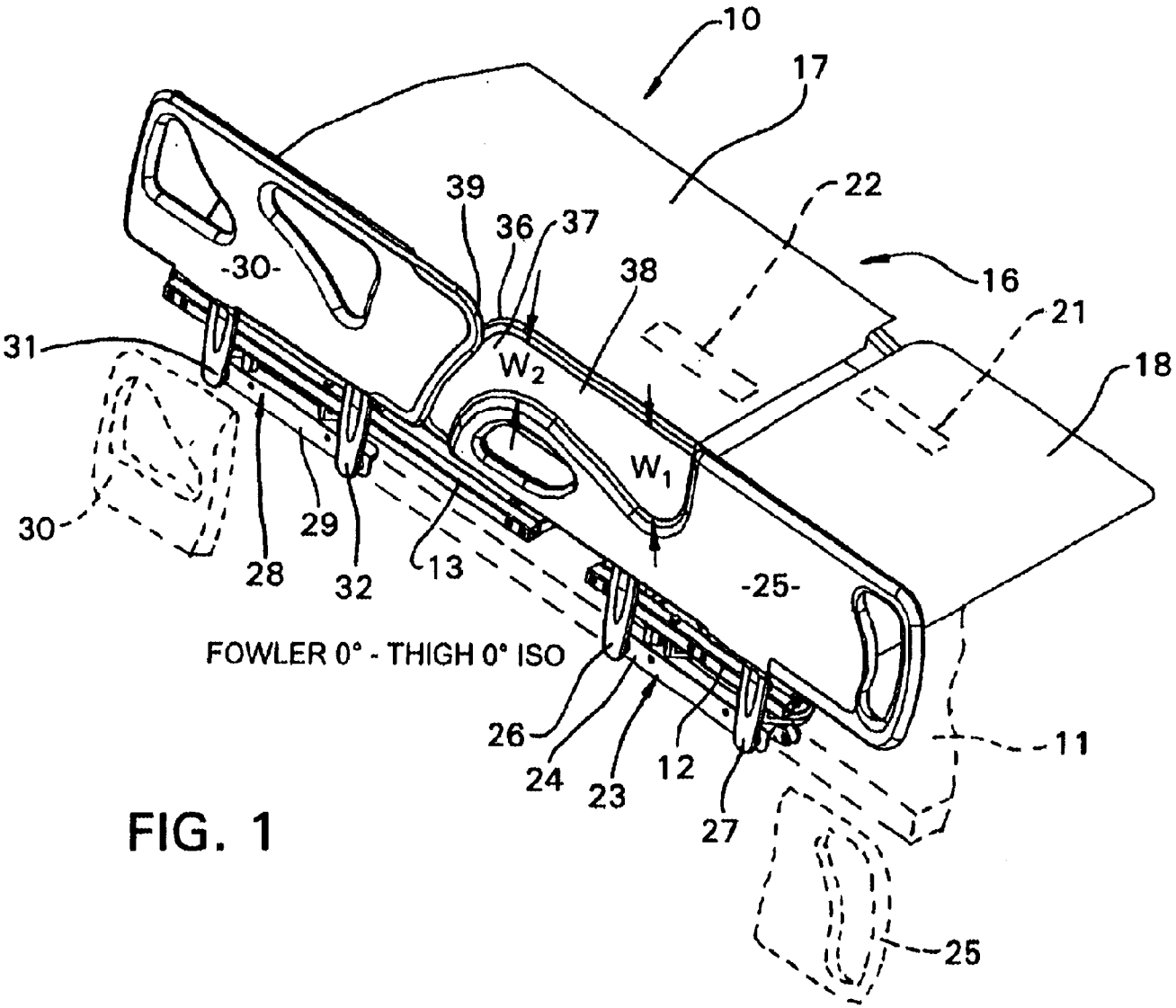
FIG. 1 is an isometric view of a fragment of a patient care bed and a siderail configuration thereon embodying the invention.

A bed 10 embodying the invention is illustrated in the drawings. Referring first to FIG. 1, the bed 10 includes a primary frame 11 which is provided on a wheel mounted base of a conventional variety (not illustrated). The frame 11 includes a secondary seat/thigh frame 12 as well as a secondary head end frame 13, each independently pivotally mounted thereon and for movement about a pivot axis that extends perpendicular to a longitudinal axis of the bed. A patient support deck 16 is provided and consists of a head end section 17 and a seat/thigh section 18. In this particular embodiment, the head end section 17 and the seat/thigh section 18 are mounted respectively to the secondary head end and seat/thigh frames 13 and 12.

A drive motor 21 is provided either on the frame 11 or on the seat/thigh section 18 and is configured to effect an elevation of the seat/thigh section 18 from and between a horizontally aligned position and an inclined position relative to the horizontal whereat the foot end thereof is higher than the head end thereof. Similarly, a drive motor 22 is provided either on the frame 11 or the head end section 17 and is configured to effect a movement of the head end section 17 from and between a horizontally aligned position and an elevated position whereat the head end thereof is at a higher elevation than the seat/thigh end thereof. These drive motors and their connections to effect the relative movement of the seat/thigh section 18 and the head end section 17 are conventional.

A siderail mechanism 23 embodying the invention is provided on each side of the bed 10. However, only one side is being illustrated for convenience. Further, there are two support mechanisms 23 and 28 provided on each side of the bed, one support mechanism for a foot end siderail 25 and the other for a head end siderail 30. While in this particular embodiment the support mechanisms 23 and 28 are mounted directly to the respective seat/thigh frame 12 and head end frame 13, it is within the scope of this invention to provide additional and separately mounted frames on the frame 11, each separate frame being adjacent the respective seat/thigh frame 12 and head end frame 13 and to mount the respective support mechanisms 23 and 28 directly to the respective additional and separate frames so that the head end section 17 and seat/thigh section 18 can move about their respective axes independently of the separate and additional frames supporting the support mechanisms 23 and 28.

The support mechanism 23 includes a mount 24 to which is pivotally secured a pair of parallel arms 26 and 27. The arms are pivotal between the position illustrated in FIG. 1 where they extend vertically upwardly from the mount 24 when the siderail 25 is in a raised and deployed condition to a position oriented 100° to 180° therefrom whereat they extend downwardly from the mount 24. The siderail 25 is pivotally secured to the distal end of each of the arms 26 and 27. As a result, and when the arms 26 and 27 pivot from their vertically upright position through a 100° to 180° angle to a downwardly oriented position, the siderail 25 is effectively shifted from its vertically elevated position shown in solid lines in FIG. 1 to a lowered position illustrated in broken lines in FIG. 1.

Similarly, the siderail support mechanism 28 is provided on both sides of the head end section 17 of the bed 10, however, only one side is illustrated in FIG. 1. The support mechanism 28 includes a mount 29 to which is pivotally secured an arm 31 and 32. Each arm 31 and 32 is pivotally secured to the mount 29 and is configured to move from a vertically upright and parallel orientation illustrated in FIG. 1 through an angle range of 100° to 180° to a downwardly oriented position from the mount 29. A siderail 30 is pivotally secured to the distal end of each of the arms 31 and 32. When the arms 31 and 32 pivot through the aforesaid angle, the siderail 30 is effectively moved from an elevated position illustrated in solid lines in FIG. 1 to a lowered position illustrated in broken lines in FIG. 1.

Figure 2:
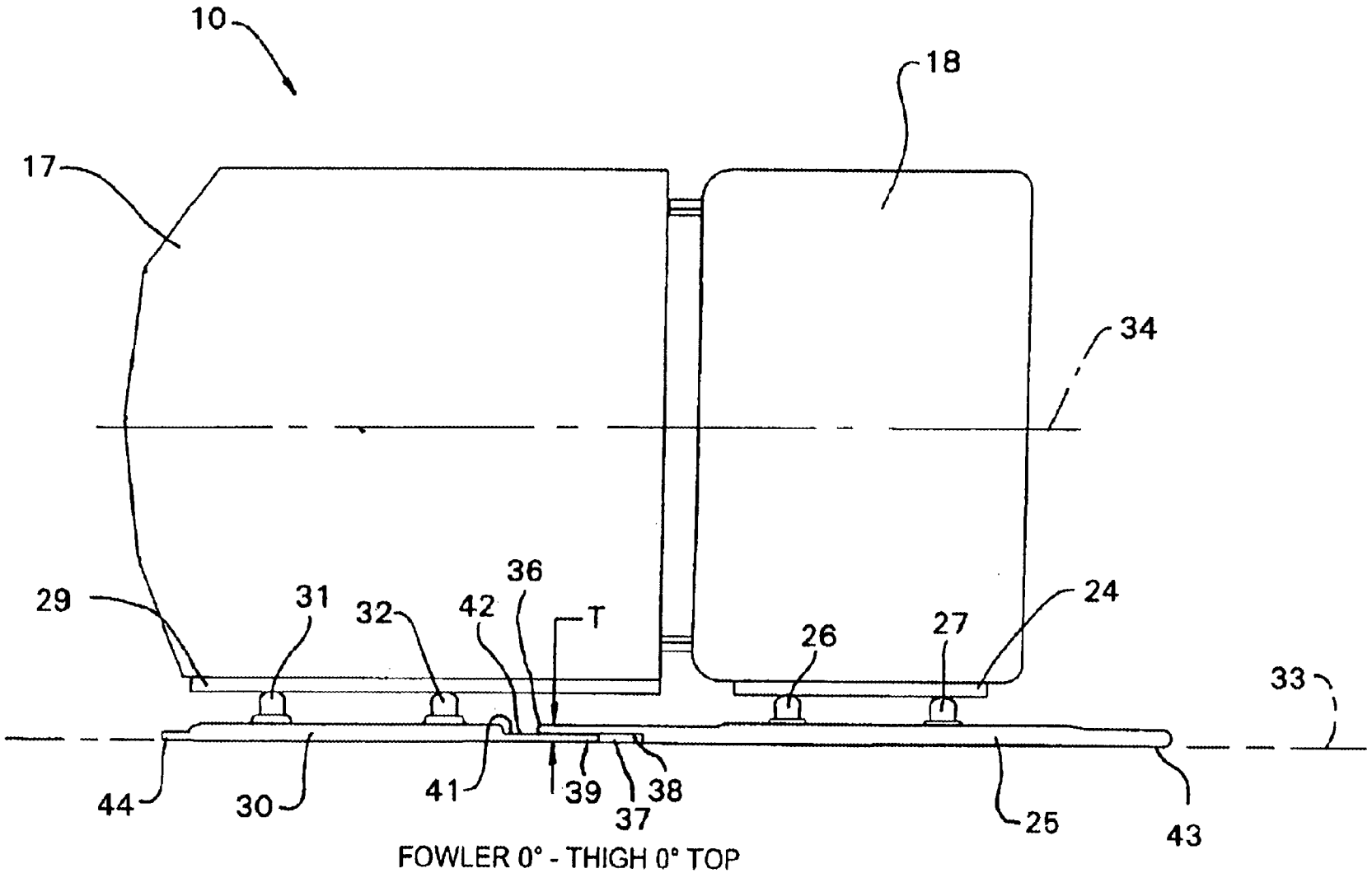
FIG. 2 is a top view of FIG. 1.

As illustrated in FIG. 2, each of the siderails 25 and 30 are contained in a plane 33 that is parallel to a vertically upright plane 34 containing a longitudinal axis of the bed 10. Furthermore, each of the siderails 25 and 30 have a uniform thickness extending over a majority of the length of each of the respective siderail components. The head end 36 of the siderail 25 has a region 37 of reduced thickness facing outwardly away from the plane 34. The outwardly facing surface 38 of the region 37 extends in a plane generally parallel to the aforesaid plane 34. Similarly, the foot end 39 of the siderail 30 has a region 41 of reduced thickness facing inwardly toward the plane 34. The surface 42 of the region 41 extends parallel to the plane 34. As illustrated in FIG. 2, the opposing surfaces 38 and 42 overlap and are in a side-by-side arrangement so as to prevent the formation of a longitudinal gap between the respective siderails 25 and 30. In addition, the total thickness T (FIG. 2) of the head end 36 of the siderail 25 and the foot end 39 of the siderail 30 is of a thickness generally conforming to the overall uniform thickness of each of the respective siderails 25 and 30. The foot end 43 of the siderail 25 and the head end 44 of the siderail 30 are also reduced in thickness for reasons that are not significant to this invention.

As stated above, the siderail configuration illustrated in FIG. 2 is duplicated on the other side of the bed 10. It is therefore believed unnecessary to illustrate in the drawings: and to provide an additional description of the duplicative structure.

Figure 8:
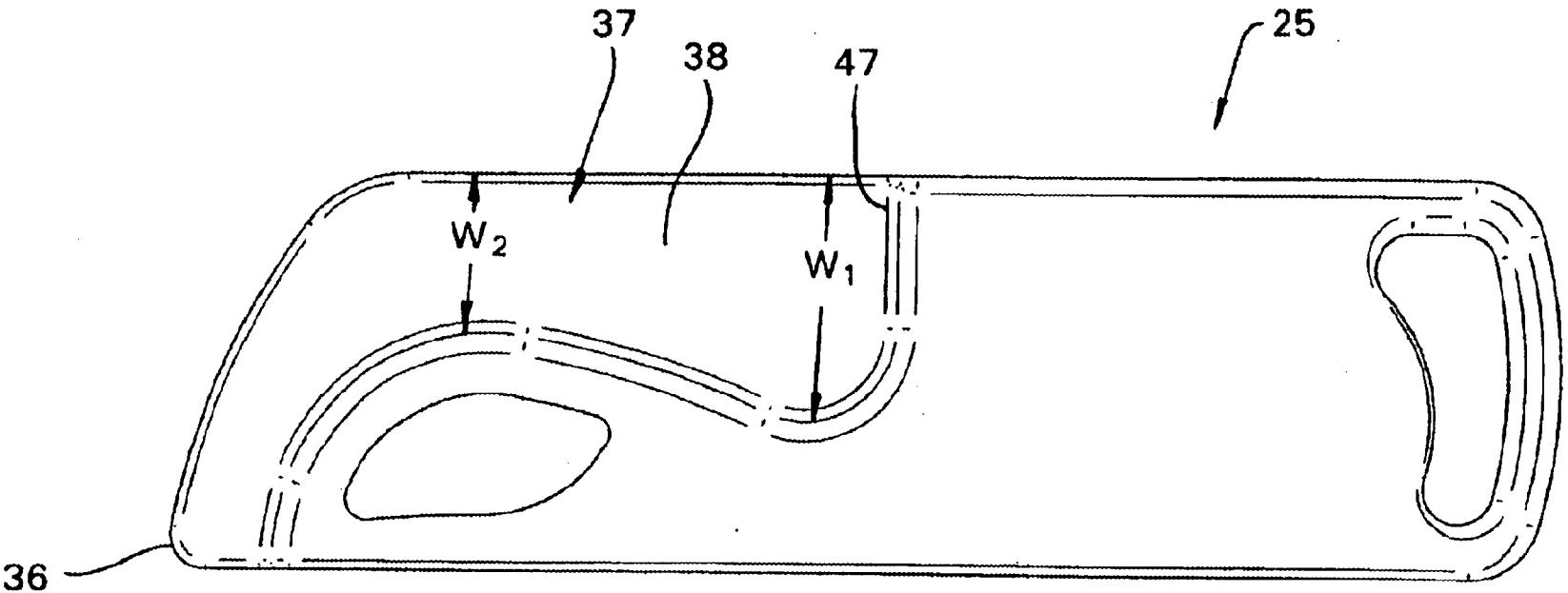
FIG. 8 is a front view of the foot end siderail for the seat and thigh section.

Referring to FIGS. 1 and 8, the region 37 of reduced thickness is generally L-shaped, the short leg of the L being provided at the head end 36 and the long leg of the L extending coextensively with the siderail 25 adjacent the upper edge thereof. The width $W_1$ at about the midlength of the siderail 25 is greater than the width $W_2$ immediately adjacent the short leg of the L of the region 37.

Figure 9:
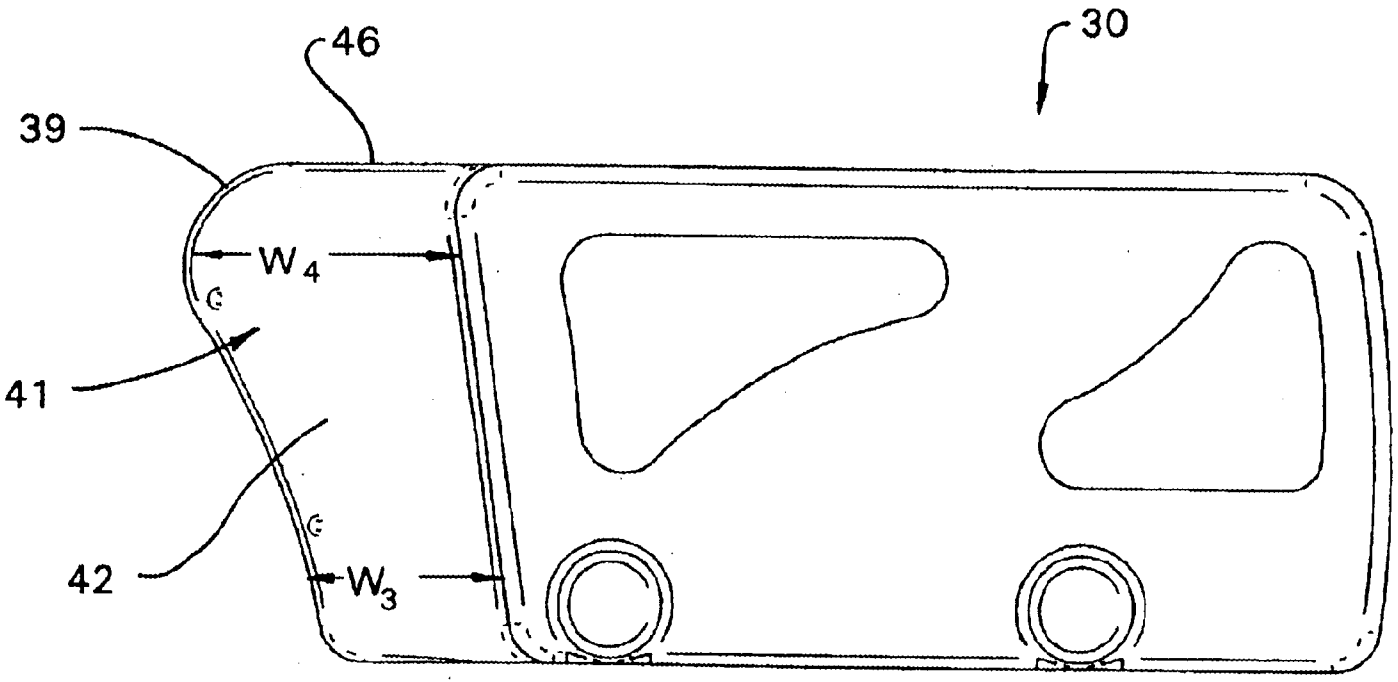
FIG. 9 is a rear view of the head end siderail for the head end section.

Referring to FIG. 9, the region 41 on the siderail 30 has generally a uniform width $W_3$ in the horizontal direction over :the lower half and a width $W_4$ over the upper half. The purpose of the aforesaid shapes of the respective regions 37 and 41 will become apparent upon reading the following description of the sequence of operation.

It is preferable that the siderails 25 and 30 are made of synthetic resin material and are configured to be manufactured by a molding process.

OPERATION

Although the operation of the siderail mechanism described above will be understood from the foregoing description by skilled persons, a summary of such description is now given for convenience.

Figure 3:
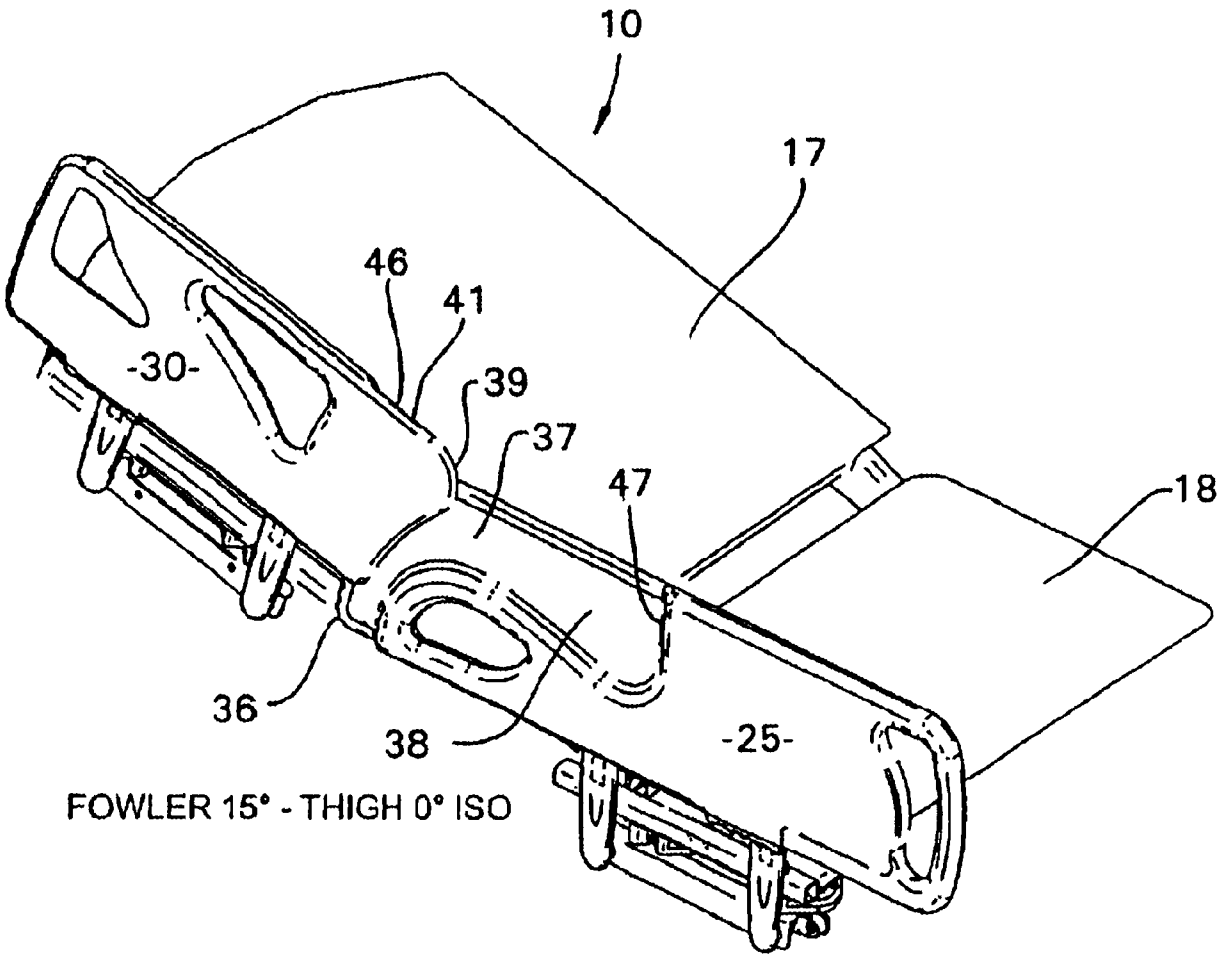
FIG. 3 is an isometric view similar to FIG. 1, except that the head end section is inclined at about 15° with respect to the seat and thigh section.
Figure 4:
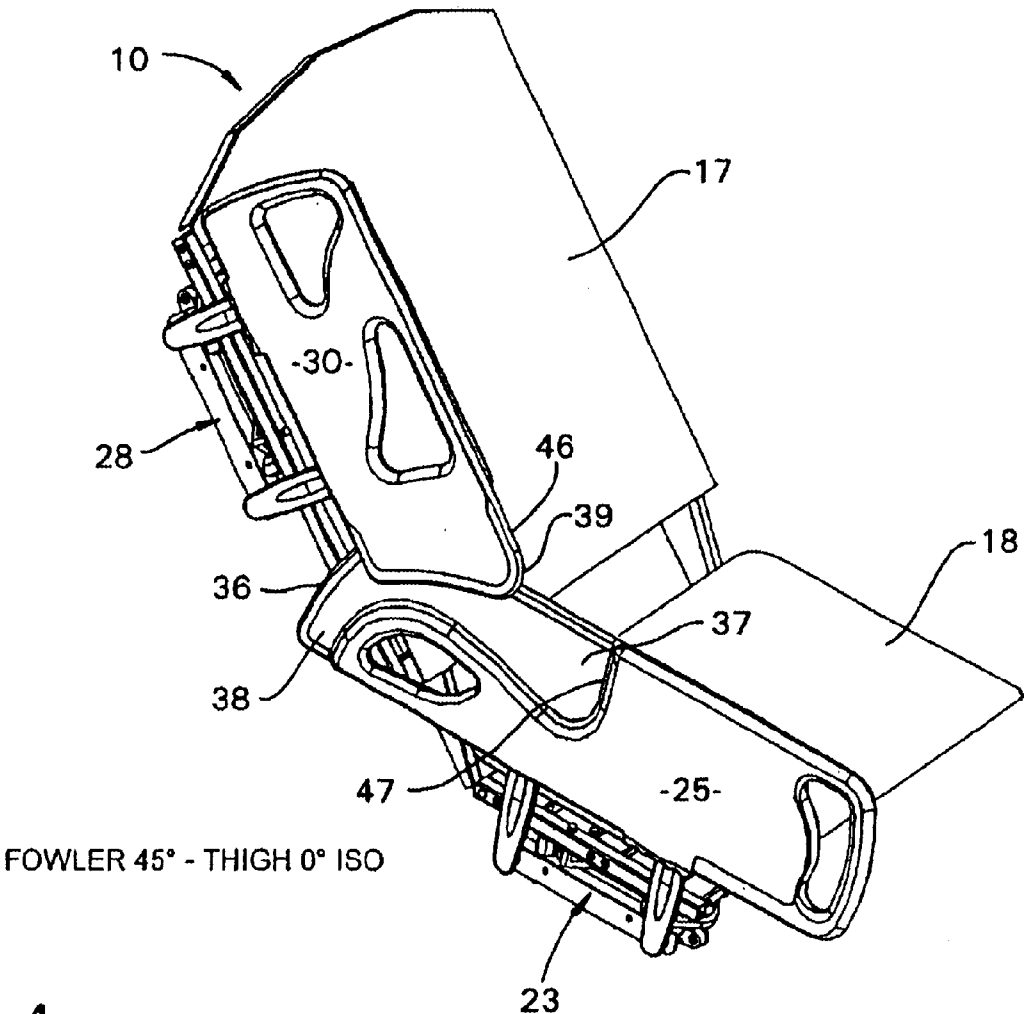
FIG. 4 is a view similar to FIG. 1, except that the head end section is inclined at about 45° to the seat and thigh section.
Figure 5:
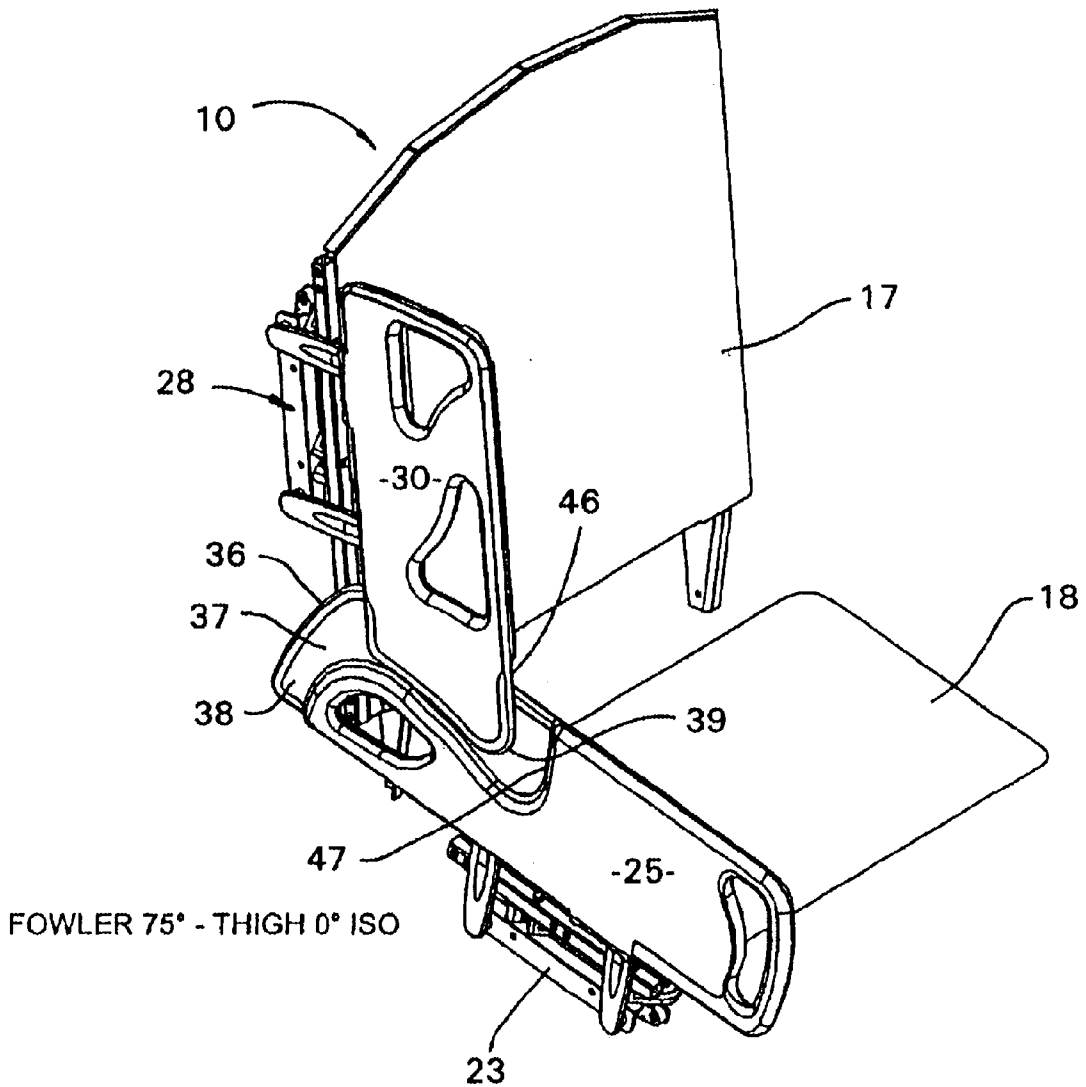
FIG. 5 is a view similar to FIG. 1, except that the head end section is inclined at about 75° relative to the seat and thigh section.
Figure 6:
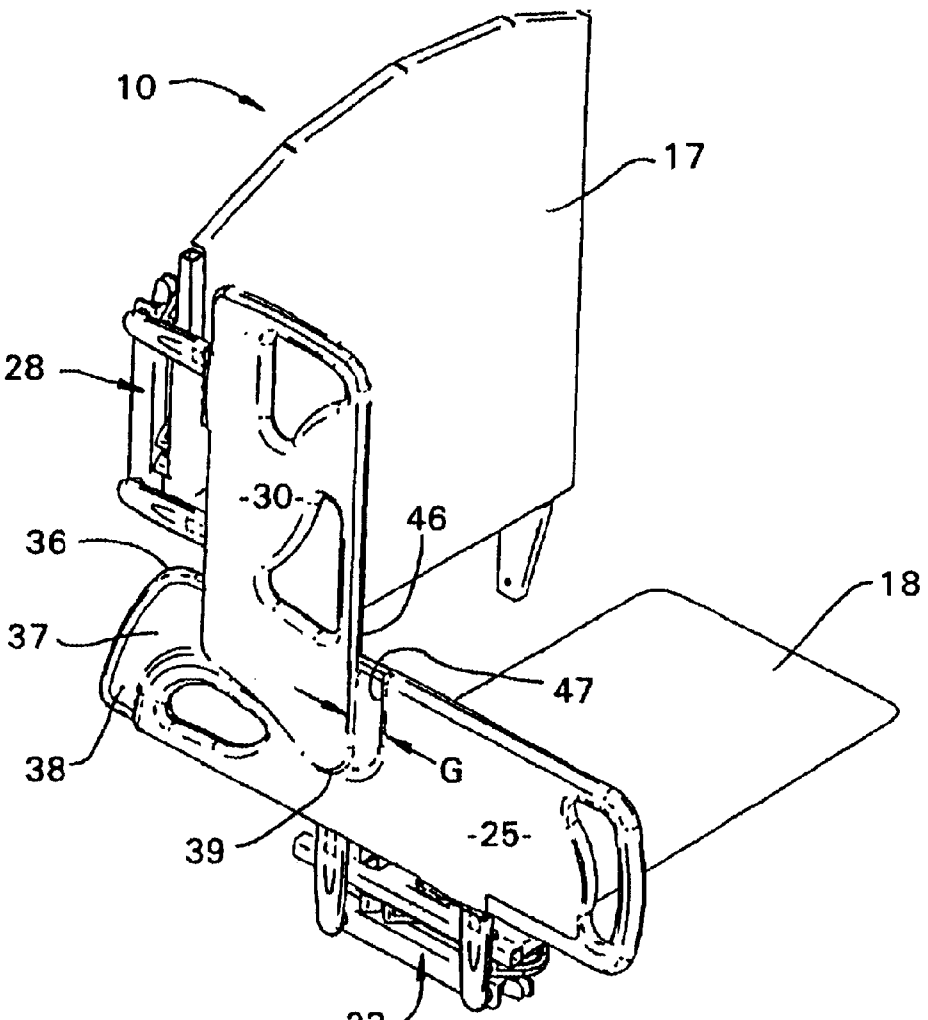
FIG. 6 is an isometric view similar to FIG. 1, except that the head end section is inclined at about 90° relative to the horizontal.
Figure 7:
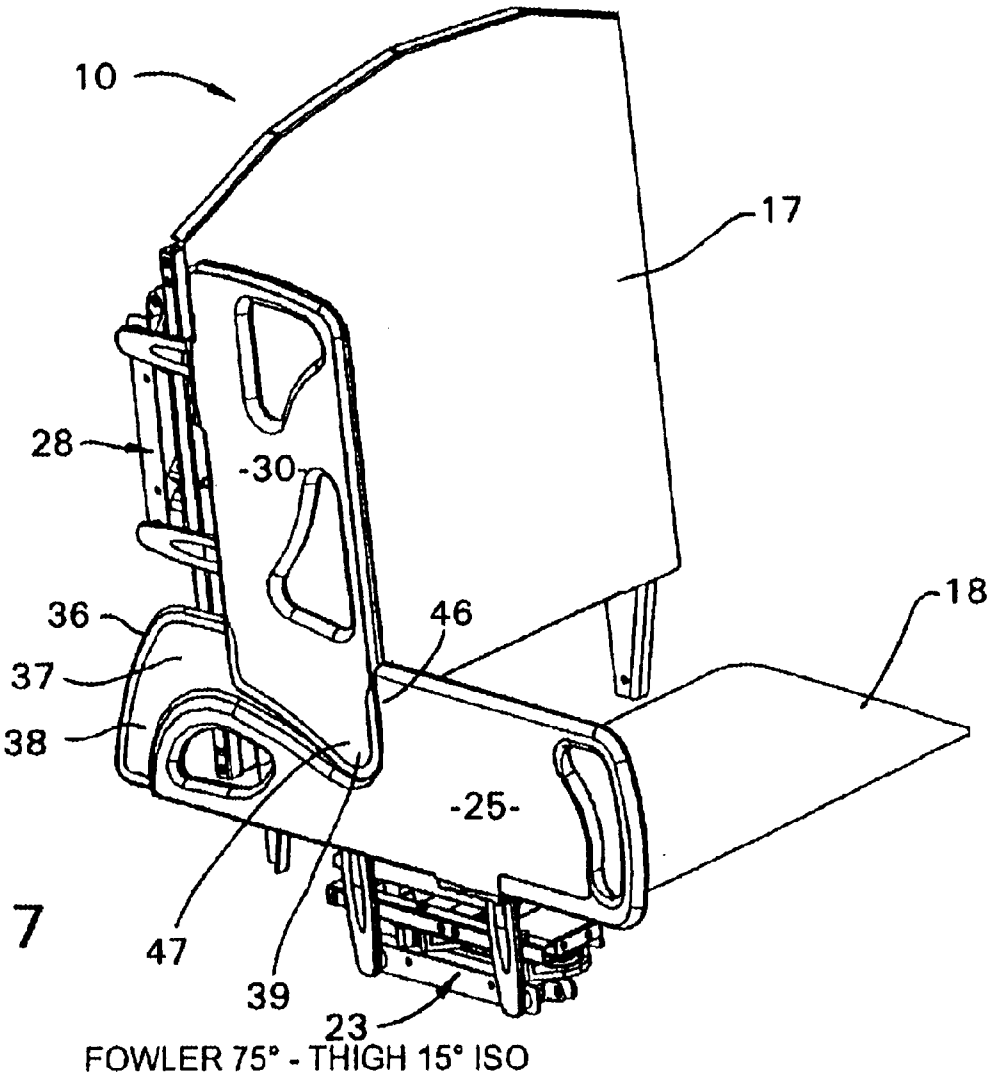
FIG. 7 is a view similar to FIG. 5, except that the seat and thigh section is inclined about 15° relative to the horizontal.

FIG. 1 illustrates an orientation of the head end section 17 and the seat and thigh section 18 at 0° relative to the horizontal. In this position, the foot end of the siderail 30 overlaps the head end of the siderail 25 as illustrated in FIG. 2 and described above. As the head end section 17 is advanced from the horizontal position to a position approximately 15° raised above the horizontal, and as illustrated in FIG. 3, the siderail 30 is shifted toward the foot end relative to the siderail 25 while the overlapping regions 37 and 41 remain overlapping. As the head end section 17 advances through the FIGS. 4, 5 and 6 positions, FIG. 6 illustrating the head end section 17 being oriented at approximately 90° with respect to the horizontal plane, the foot end 39 of the siderail 30 moves along the long leg of the L of the region 37 so that the foot end 39 of the siderail 30 is received into the larger width $W_1$ section of the region 37. It will be noted that there remains a gap G (FIG. 6) between a top edge 46 of the siderail 30 and a head end facing edge 47 of the region 37 at the midlength portion of the siderail 25. The gap G is provided so that when the drive motor 21 effects an elevation of the seat and thigh section 18 to an angle of approximately 15° relative to the horizontal, the siderail 25 will move therewith so as to close the gap G as shown in FIG. 7.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. An elongate patient care bed, comprising:

a frame having a head end and a foot end;

a support deck mounted on said frame, said support deck having a head end section, a seat section, said head end section being supported for movement relative to said seat section and between a horizontally aligned position and an upright position inclined relative to said horizontally aligned position;

at least one pair of siderails on one side of said bed, each one of said at least one pair having a generally uniform thickness over a majority of a length of each thereof and extend in a plane that is generally parallel to a plane containing a central longitudinal axis of said elongate bed, a first one of said pair being mounted at said head end of said frame and configured to move with said head end section, a second one of said pair being mounted toward the foot end from said first one and configured to remain stationary relative to said seat section during a transition of said head end section between said horizontally aligned and inclined positions;

each of said first and second ones of said pair having a head end and a foot end, said foot end of said first one having a first region of reduced thickness on a first side thereof facing in a first direction, said head end of said second one having a second region of reduced thickness on a second side thereof facing in a second direction opposite to said first direction, said first and second regions being oriented in an overlapping side-by-side relation so that there exists no longitudinal gap between said first and second ones of said pair in all positions of said head end section relative to said seat section.

2. The elongate bed according to claim 1, wherein each of said first and second ones of said pair of siderails include a support mechanism configured to raise and lower a respective siderail relative to a plane containing a respective section of said support deck.

3. The elongate bed according to claim 2, wherein said support mechanism for said second one of said pair is mounted directly to an underside of said seat section.

4. The elongate bed according to claim 2, wherein said support mechanism for said first one of said pair is mounted directly to an underside of said head end section.

5. The elongate bed according to claim 2, wherein said frame includes a head end frame, wherein said support mechanism for said first one of said pair is mounted directly to said head end frame, said head end frame being mounted on said frame and supported for movement relative to said seat section between a horizontally aligned position and an upright position inclined relative to said horizontally aligned position.

6. The elongate bed according to claim 5, wherein said head end section of said support deck is mounted on said head end frame and is configured to move therewith.

7. The elongate bed according to claim 5, wherein said overlapping and side-by-side first and second regions and a remainder of each of said first and second ones of said pair have a generally uniform thickness between said head end of said first one and said foot end of said second one.

8. The elongate bed according to claim 7, wherein said uniform thickness between said head end of said first one and said foot end of said second one exists in all positions of said head end frame relative to said seat section.

9. The elongate bed according to claim 2, wherein said frame includes a head end frame and at least one additional frame separately mounted from said head end frame, said support mechanism for said one of said pair being mounted directly to said additional frame.

10. The elongate bed according to claim 1, wherein said overlapping and side-by-side first and second regions and a remainder of each of said first and second ones of said pair have a generally uniform thickness between said head end of said first one and said foot end of said second one.

11. The elongate bed according to claim 10, wherein said uniform thickness between said head end of said first one and said foot end of said second one exists in all positions of said head end section relative to said seat section.

12. The elongate bed according to claim 1, wherein said first and second regions of reduced thickness are of equal thickness.

* * * * *